US006802279B1

(12) United States Patent
Johnson

(10) Patent No.: US 6,802,279 B1
(45) Date of Patent: Oct. 12, 2004

(54) MEDICINE MINDER

(76) Inventor: Hobert L. Johnson, 105 Southfork La., Belmont, NC (US) 28012

( * ) Notice: Subject to any disclaimer, the term of this patent is extended or adjusted under 35 U.S.C. 154(b) by 0 days.

(21) Appl. No.: 10/641,765

(22) Filed: Aug. 15, 2003

(51) Int. Cl.[7] ..... G09F 9/00

(52) U.S. Cl. ..... 116/306; 116/311; 40/310; 40/633

(58) Field of Search ..... 116/306, 307, 116/308, 309, 311, 312, 313, 319, 321, 322, 200; 40/310, 665, 666, 633

(56) References Cited

U.S. PATENT DOCUMENTS

| | | | | |
|---|---|---|---|---|
| 844,054 A | | 2/1907 | Swope | |
| 1,397,079 A | * | 11/1921 | Cohen | 40/665 |
| 1,796,398 A | | 3/1931 | Richardson | |
| 2,528,259 A | * | 10/1950 | Annunziata | 116/308 |
| 2,625,131 A | | 1/1953 | Sturhahn | |
| 3,766,882 A | * | 10/1973 | Babbitt, III | 116/308 |
| 3,996,879 A | | 12/1976 | Walton | |
| 4,405,045 A | * | 9/1983 | Villa-Real | 206/534 |
| 4,913,083 A | * | 4/1990 | Valvo et al. | 116/308 |
| 4,951,596 A | | 8/1990 | Wallace, Jr. | |
| 5,046,446 A | * | 9/1991 | Sumrall et al. | 116/200 |
| 5,271,353 A | | 12/1993 | Besthorne | |
| 5,433,324 A | * | 7/1995 | Leonard | 206/534 |
| 5,482,163 A | | 1/1996 | Hoffman | |
| 6,752,431 B1 | * | 6/2004 | Matthews et al. | 283/81 |

* cited by examiner

*Primary Examiner*—Christopher W. Fulton
*Assistant Examiner*—Amy R. Cohen

(57) ABSTRACT

A medicine minder has an elastic band capable of detachable attachment to a conventional medical prescription bottle. An indicator is connected to the elastic band and has a first side, a second side, a first indicia indicating medicine needs to be taken, and a second indicia indicating medicine has been taken. A band hook and loop fastener is connected to the elastic band. A first side hook and loop fastener is connected to the indicator first side detachable mount end. A second side hook and loop fastener is connected to the indicator second side detachable mount end.

19 Claims, 2 Drawing Sheets

MEDICINE MINDER

BACKGROUND OF THE INVENTION

1. Field of the Invention

The present embodiment of the invention relates to a medicine minder for use in connection with reminder devices. The medicine minder has particular utility in connection with medicine reminder devices which have a hook and loop strap to indicate whether medicine has been taken.

2. Description of the Prior Art

Medicine minders are desirable for reminding individuals whether they have taken their medication in a timely manner and to prevent double medicating due to forgetting. A need was felt for a medicine minder that could easily be detachably connected to a medicine bottle and which would have a hook and loop strap that could be positioned to show whether medication had been taken.

The use of reminder devices is known in the prior art. For example, U.S. Pat. No. 5,482,163 to Hoffman discloses a last event indicator apparatus includes a cylindrical support having a longitudinal axis, an outer surface and a tapered flange structure. The tapered flange structure has a first end having a first diameter and a second end having a second diameter that is greater than the first diameter of the first end. An expandable indicator ring is disposed over the outer surface. The indicator ring is axially displaceable along the longitudinal axis to engage the tapered flange structure and cause expansion of the indicator ring. The expandable indicator ring is rotatable about the longitudinal axis over the outer surface to each of a plurality of selected positions. However, the Hoffman '163 patent does not have an elastic band having a sign portion with indicia upon both sides to indicate whether medicine has been taken.

Similarly, U.S. Pat. No. 5,271,353 to Besthorne discloses a medicine reminder device for a medicine container is provided and consists of a mechanism for removably attaching a housing having a clock face thereon to the medicine container. Hour and minute hands are pivotally mounted to the clock face so that a person can manually move the hour and minute hands to indicate the time medicine must be taken from the medicine container. However, the Besthorne '353 patent does not have an elastic band having a sign portion with indicia upon both sides to indicate whether medicine has been taken.

Lastly, U.S. Pat. No. 3,996,879 to Walton discloses a reminder device having a band or collar which fits around a container and displays notations such as days or dates. A display unit with windows is mounted on the band or collar, and the display unit has a spring loaded and movable slide element to selectively cover a window and the notation associated therewith. However, the Walton '879 patent does not have an elastic band having a sign portion with indicia upon both sides to indicate whether medicine has been taken.

While the above-described devices fulfill their respective, particular objectives and requirements, the aforementioned patents do not describe a medicine minder that allows medicine reminder devices which have a hook and loop strap to indicate whether medicine has been taken. The Hoffman '163, Besthorne '353 and Walton '879 patents make no provision for an elastic band having a sign portion with indicia upon both sides to indicate whether medicine has been taken.

Therefore, a need exists for a new and improved medicine minder which can be used for medicine reminder devices which have a hook and loop strap to indicate whether medicine has been taken. In this regard, the present embodiment of the invention substantially fulfills this need. In this respect, the medicine minder according to the present embodiment of the invention substantially departs from the conventional concepts and designs of the prior art, and in doing so provides an apparatus primarily developed for the purpose of medicine reminder devices which have a hook and loop strap to indicate whether medicine has been taken.

SUMMARY OF THE INVENTION

In view of the foregoing disadvantages inherent in the known types of reminder devices now present in the prior art, the present embodiment of the invention provides an improved medicine minder, and overcomes the above-mentioned disadvantages and drawbacks of the prior art. As such, the general purpose of the present embodiment of the invention, which will be described subsequently in greater detail, is to provide a new and improved medicine minder and method which has all the advantages of the prior art mentioned heretofore and many novel features that result in a medicine minder which is not anticipated, rendered obvious, suggested, or even implied by the prior art, either alone or in any combination thereof.

To attain this, the present embodiment of the invention essentially comprises an elastic band capable of fitting upon a conventional medical prescription bottle. An indicator is connected to the elastic band and has a first side, a second side, a first indicia indicating medicine needs to be taken, and a second indicia indicating medicine has been taken. A band hook and loop fastener is connected to the elastic band. A first side hook and loop fastener is connected to the indicator first side detachable mount end. A second side hook and loop fastener is connected to the indicator second side detachable mount end.

There has thus been outlined, rather broadly, the more important features of the embodiment of the invention in order that the detailed description thereof that follows may be better understood and in order that the present contribution to the art may be better appreciated.

The present embodiment of the invention may also include a red colored indicator first side and a green colored indicator second side. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved medicine minder that has all of the advantages of the prior art reminder devices and none of the disadvantages.

It is another object of the present embodiment of the invention to provide a new and improved medicine minder that may be easily and efficiently manufactured and marketed.

An even further object of the present embodiment of the invention is to provide a new and improved medicine minder that has a low cost of manufacture with regard to both materials and labor, and which accordingly is then susceptible of low prices of sale to the consuming public, thereby making such medicine minder economically available to the buying public.

Still another object of the present embodiment of the invention is to provide a new medicine minder that provides in the apparatuses and methods of the prior art some of the advantages thereof, while simultaneously overcoming some of the disadvantages normally associated therewith.

Lastly, it is an object of the present embodiment of the invention is to provide a medicine minder for medicine reminder devices which have a hook and loop strap to indicate whether medicine has been taken.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
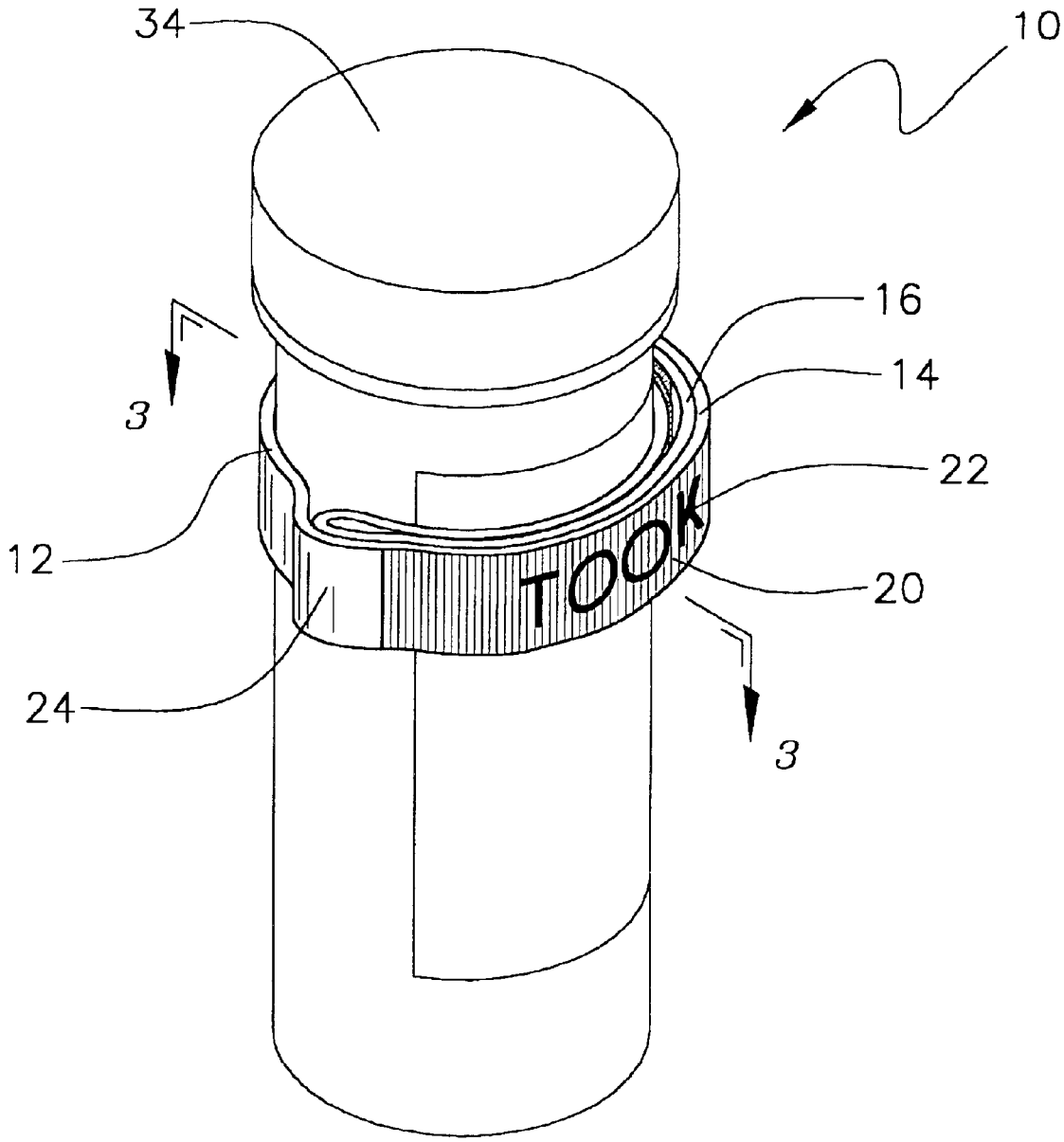
FIG. 1 is a top perspective view of the preferred embodiment of the medicine minder constructed in accordance with the principles of the present invention.

Referring now to the drawings, and particularly to FIG. 14, a preferred embodiment of the medicine minder of the present invention is shown and generally designated by the reference numeral 10.

In FIG. 1, a new and improved medicine minder 10 of the present invention for medicine reminder devices which have a hook and loop strap to indicate whether medicine has been taken is illustrated and will be described. More particularly, the medicine minder 10 has an elastic band 12 capable of detachably connected to a conventional medical prescription bottle 34. The elastic band 12 is comprised of spandex in the present example, but may be comprised of rubber or Lycra in other embodiments. An indicator 14 is connected to the elastic band 12. The indicator 14 has a second side 20. The indicator second side 20 has a second indicia 22 indicating medicine has been taken written thereupon. The indicator 14 is substantially rectangular in shape. The indicator 14 has an elastic band end 24. The indicator second indicia 22 is took. The indicator second side 20 is colored red. The indicator 14 is integrally is connected to the elastic band 12. A indicator first side 16 is frictionally is connected to the indicator second side 20. The indicator 14 is comprised of spandex in the present example, but may be comprised of rubber or Lycra in other embodiments.

Figure 2:
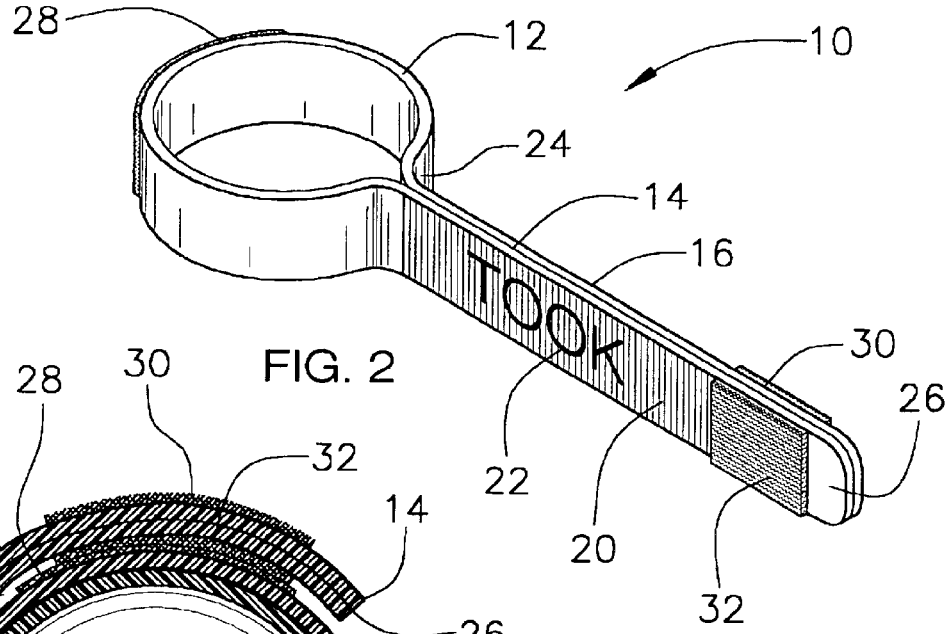
FIG. 2 is a top perspective view of the medicine minder of the present embodiment of the invention.

In FIG. 2, the medicine minder 10 is illustrated and will be described. More particularly, the medicine minder 10 has the elastic band 12. The elastic band 12 is comprised of spandex. The indicator 14 is connected to the elastic band 12. The indicator 14 has the first side 16. The indicator 14 has the second side 20. The indicator second side 20 has the second indicia 22 indicating medicine has been taken written thereupon. The indicator 14 is substantially rectangular in shape. The indicator 14 has the elastic band end 24. The indicator 14 has a detachable mount end 26. The indicator second indicia 22 is took. The indicator second side 20 is colored red. The indicator 14 is integrally is connected to the elastic band 12. The indicator first side 16 is frictionally is connected to the indicator second side 20. The indicator 14 is comprised of spandex. A band hook and loop fastener 28 is connected to the elastic band 12. A first side hook and loop fastener 30 is connected to the indicator first side 16 detachable mount end 26. A second side hook and loop fastener 32 is connected to the indicator second side 20 detachable mount end 26.

Figure 3:
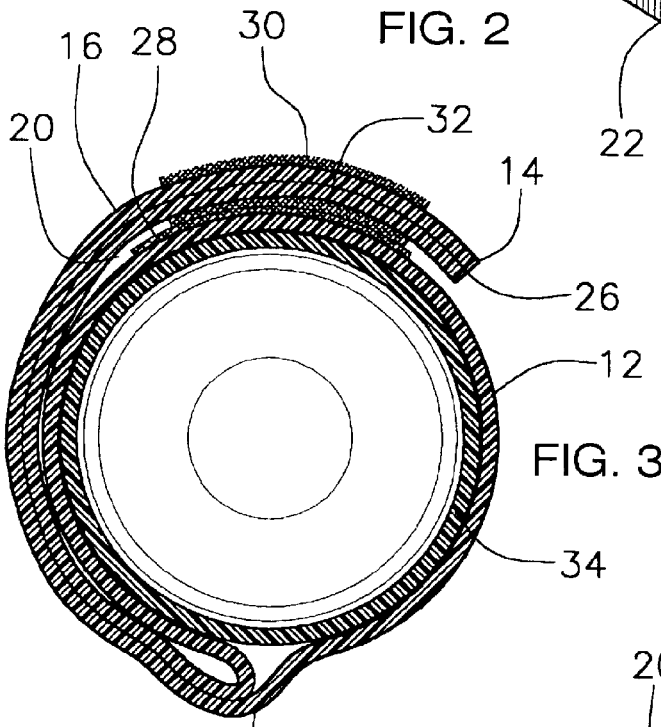
FIG. 3 is a section 3—3 view of FIG. 1 of the medicine minder of the present embodiment of the invention.

In FIG. 3, the medicine minder 10 is illustrated and will be described. More particularly, the medicine minder 10 has the elastic band 12 capable of detachably connected to the conventional medical prescription bottle 34. The elastic band 12 is comprised of spandex. The indicator 14 is connected to the elastic band 12. The indicator 14 has the first side 16. The indicator 14 has the second side 20. The indicator first side 16 has a first indicia 18 indicating medicine needs to be taken written thereupon. The indicator second side 20 has the second indicia 22 indicating medicine has been taken written thereupon. The indicator 14 is substantially rectangular in shape. The indicator 14 has the elastic band end 24. The indicator 14 has the detachable mount end 26. The indicator first indicia 18 is take. The indicator second indicia 22 is took. The indicator first side 16 is colored green. The indicator second side 20 is colored red. The indicator 14 is integrally is connected to the elastic band 12. The indicator first side 16 is frictionally is connected to the indicator second side 20. The indicator 14 is comprised of spandex. The band hook and loop fastener 28 is connected to the elastic band 12. The first side hook and loop fastener 30 is connected to the indicator first side 16 detachable mount end 26. The second side hook and loop fastener 32 is connected to the indicator second side 20 detachable mount end 26.

Figure 4:
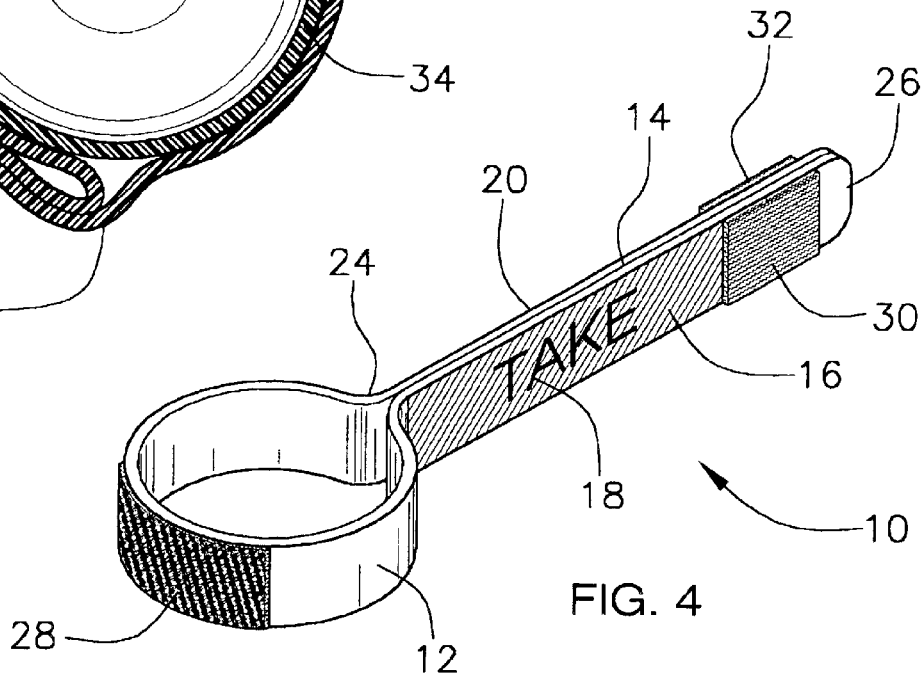
FIG. 4 is a top perspective view of the medicine minder of the present embodiment of the invention.

In FIG. 4, the medicine minder 10 is illustrated and will be described. More particularly, the medicine minder 10 has the elastic band 12. The elastic band 12 is comprised of spandex. The indicator 14 is connected to the elastic band 12. The indicator 14 has the first side 16. The indicator 14 has the second side 20. The indicator first side 16 has the first indicia 18 indicating medicine needs to be taken written thereupon. The indicator 14 is substantially rectangular in shape. The indicator 14 has the elastic band end 24. The indicator 14 has the detachable mount end 26. The indicator first indicia 18 is take. The indicator first side 16 is colored green. The indicator 14 is integrally is connected to the elastic band 12. The indicator first side 16 is frictionally is connected to the indicator second side 20. The indicator 14 is comprised of spandex. The band hook and loop fastener 28 is connected to the elastic band 12. The first side hook and loop fastener 30 is connected to the indicator first side 16 detachable mount end 26. The second side hook and loop fastener 32 is connected to the indicator second side 20 detachable mount end 26.

In use it can now be understood that the medicine minder 10 is readily secured to a medicine container. When the medicine minder 10 is in place it indicates if the last dosage was consumed and serves as an event log for the user to determine at a glance when the next dose should be taker.

While a preferred embodiment of the medicine minder has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable elastic material may be used instead of the rubber described. And although medicine reminder devices which have a hook and loop strap to indicate whether medicine has been taken have been described, it should be appreciated that the medicine minder herein described is also suitable for marking any container that requires human interaction on a scheduled basis.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

I claim:

1. A medicine minder comprising:

an elastic band capable of detachably connected to a conventional medical prescription bottle;

an indicator connected to said elastic band, said indicator having a first side, said indicator having a second side, said indicator first side having a first indicia indicating medicine needs to be taken written thereupon, said indicator second side having a second indicia indicating medicine has been taken written thereupon, said indicator substantially rectangular in shape, said indicator having an elastic band end, said indicator having a detachable mount end;

a band hook and loop fastener connected to said elastic band;

a first side hook and loop fastener connected to said indicator first side detachable mount end; and a second side hook and loop fastener connected to said indicator second side detachable mount end.

2. The medicine minder of claim 1 wherein:

said indicator first indicia being take.

3. The medicine minder of claim 1 wherein:

said indicator second indicia being took.

4. The medicine minder of claim 1 wherein:

said indicator first side being colored green.

5. The medicine minder of claim 1 wherein:

said indicator second side being colored red.

6. The medicine minder of claim 1 wherein:

said indicator is integrally connected to said elastic band.

7. The medicine minder of claim 1 wherein:

said indicator first side is frictionally connected to said indicator second side.

8. The medicine minder of claim 1 wherein:

said elastic band is comprised of spandex; and said indicator is comprised of spandex.

9. The medicine minder of claim 1 wherein:

said elastic band is comprised of rubber, and said indicator is comprised of rubber.

10. The medicine minder of claim 1 wherein:

said elastic band is comprised of Lycra; and said indicator is comprised of Lycra.

11. A medicine minder comprising:

an elastic band capable of detachably connected to a conventional medical prescription bottle;

an indicator connected to said elastic band, said indicator having a first side, said indicator having a second side, said indicator first side having a first indicia indicating medicine needs to be taken written thereupon, said indicator second side having a second indicia indicating medicine has been taken written thereupon, said indicator substantially rectangular in shape, said indicator having an elastic band end, said indicator having a detachable mount end, said indicator first indicia being take, said indicator second indicia being took;

a band hook and loop fastener connected to said elastic band;

a first side hook and loop fastener connected to said indicator first side detachable mount end; and a second side hook and loop fastener connected to said indicator second side detachable mount end.

12. The medicine minder of claim 1 wherein:

said indicator first side being colored green.

13. The medicine minder of claim 12 wherein:

said indicator second side being colored red.

14. The medicine minder of claim 13 wherein:

said indicator is integrally connected to said elastic band.

15. The medicine minder of claim 14 wherein:

said indicator first side is frictionally connected to said indicator second side.

16. The medicine minder of claim 15 wherein:

said elastic band is comprised of spandex; and said indicator is comprised of spandex.

17. The medicine minder of claim 15 wherein:

said elastic band is comprised of rubber; and said indicator is comprised of rubber.

18. The medicine minder of claim 15 wherein:

said elastic band is comprised of Lycra; and said indicator is comprised of Lycra.

19. A medicine minder comprising:

an elastic band capable of detachably connected to a conventional medical prescription bottle, said elastic band is comprised of spandex;

an indicator connected to said elastic band, said indicator having a first side, said indicator having a second side, said indicator first side having a first indicia indicating medicine needs to be taken written thereupon, said indicator second side having a second indicia indicating medicine has been taken written thereupon, said indicator substantially rectangular in shape, said indicator having an elastic band end, said indicator having a detachable mount end, said indicator first indicia being take, said indicator second indicia being took, said indicator first side being colored green, said indicator second side being colored red, said indicator is integrally connected to said elastic band, said indicator first side is frictionally connected to said indicator second side, said indicator is comprised of spandex;

a band hook and loop fastener connected to said elastic band;

a first side hook and loop fastener connected to said indicator first side detachable mount end; and a second side hook and loop fastener connected to said indicator second side detachable mount end.

* * * * *